US006408478B1

(12) United States Patent
Kazumura

(10) Patent No.: US 6,408,478 B1
(45) Date of Patent: Jun. 25, 2002

(54) FOAM GENERATING NET FOR WASHING THE FACE

(76) Inventor: Izumi Kazumura, 16-5, Jingumae 6-Chome, Shibuya-ku, Tokyo (JP)

( * ) Notice: Subject to any disclaimer, the term of this patent is extended or adjusted under 35 U.S.C. 154(b) by 0 days.

(21) Appl. No.: 09/247,079

(22) Filed: Feb. 9, 1999

(51) Int. Cl.[7] ..... A47K 7/02
(52) U.S. Cl. ..... 15/209.1; 15/229.11
(58) Field of Search ..... 15/209.1, 229.11

(56) References Cited

U.S. PATENT DOCUMENTS

| | | | | | |
|---|---|---|---|---|---|
| 4,017,949 | A | * | 4/1977 | Botvin | 15/229.11 |
| 5,465,452 | A | * | 11/1995 | Girardot | 15/229.11 |
| 5,530,985 | A | * | 7/1996 | Tsai | 15/229.11 |
| 5,630,245 | A | * | 5/1997 | Tuthill | 15/229.11 |
| 5,715,561 | A | * | 2/1998 | Tuthill | 15/229.11 |
| 5,758,386 | A | * | 6/1998 | Chen | 15/229.11 |
| 5,947,564 | A | * | 9/1999 | Chen | 15/229.11 |
| 6,092,257 | A | * | 7/2000 | Chen | 15/229.11 |

FOREIGN PATENT DOCUMENTS

| | | |
|---|---|---|
| EP | WO96/23439 | 8/1996 |
| JP | 48-42768 | 6/1973 |
| JP | 54-77141 | 6/1979 |
| JP | 302-9093 | 9/1996 |
| JP | 10-276928 | 10/1998 |

OTHER PUBLICATIONS

*The Nikkei Marketing Journal*, Jun. 7, 1997, p. 4, published by Nihon Keizai Shimbun, Inc.

*Dime*, Nov. 20, vol. 12, No. 22, pp. 100 to 101, published on Nov. 20, 1997 by Shogakukan.

*H20* (Feb. 1998), vol. 7, No. 5, p.1 53, published on Feb. 1, 1998 by Nihon Hoso Kyokai.

*Suteki–na Okusan* (Apr.), vol. 9, No. 4, p. 50, published on Apr. 1, 1998 by Shufu–to Seikatsu sha.

*Kireini Naritai* (Nov. 1998), vol. 4, No. 11, p. 51, published on Nov. 12, 1998 by Orange Page Co. Ltd.

*Genki–ga Deru Karada–no Hon* vol. 3 (Orange Page Mook), p. 39, published on Dec. 26, 1998 by Orange Page Co., Ltd.

* cited by examiner

*Primary Examiner*—Randall E. Chin
(74) *Attorney, Agent, or Firm*—Birch, Stewart, Kolasch & Birch, LLP

(57) ABSTRACT

There is disclosed a net to foam for washing the face, wherein a cylindrical integrally molded plastic net 100 to 280 mm in width, which has vertically and horizontally arranged fine meshes having a size on the order on several millimeters, is cut into a length of 100 to 280 mm, each of the opposite ends thereof is turned inside, gathered, and fixed, with a string or other sewing piece or by heat fusion, so that it may have an arcuate shape spread radially from the gathered end to be continuous to the cylindrical wall, and a ring through which one's finger is inserted is attached to one end thereof. According to the net to foam for washing the face, a soft and silky foam that is friendly to the skin can be easily obtained without applying a facial washing toiletry directly to the skin.

7 Claims, 5 Drawing Sheets

FOAM GENERATING NET FOR WASHING THE FACE

FIELD OF THE INVENTION

The present invention relates to a foam generating net for washing the face that can foam a facial washing toiletry, such as liquid soap or solid soap, finely and silkily when someone washes makeup off or washes the face with the facial washing toiletry.

BACKGROUND OF THE INVENTION

Conventionally, it takes much time to foam a face-washing toiletry, such as liquid soap or solid soap, and it is very difficult to obtain a finely creamy foam, when someone washes makeup off or washes the face. Accordingly, a facial washing toiletry is directly applied to one's skin without particularly foaming it; then the skin is rubbed with one's hands, to let the facial washing toiletry interact with the dirt, and the facial washing toiletry, together with the dirt, is washed away with water.

However, the application of a facial washing toiletry having a high concentration directly to the skin cannot bring about a high cleaning effect, and it can also overly stimulate the skin, causing such undesirable trouble as roughened skin. Accordingly, there is a need for a facial washing toiletry having a low concentration, or an auxiliary item, friendly to the skin.

Generally, it can also be demonstrated that bubbles adsorb dirt particles more strongly than a simple solution and increase detergency, by the fact that, when the bubble part of a soiled cleaning solution is separated, and the concentration of the dirt particles absorbed to the bubbles is compared with that in the solution, the concentration of the dirt in the bubbles is quite high.

On the facial skin surface are attached aged and oxidized sebum film, dead keratin cells, worn-out makeup, dirt and bacteria in the air, etc., and the dirt composed of them clogs up the pores, readily resulting in comedones, which, if not properly treated, develop into pimples with inflammation.

To prevent pimples and roughened skin, it is required to remove dirt to keep the skin surface clean at all times, and the fundamental act of maintaining cleanness is washing the face.

The sebum component is decomposed by salt and urea in sweat, bacteria always present on the skin, pollutants in the atmosphere, ultraviolet light, oxygen in the atmosphere, and the like, to affect the skin harmfully, or the decomposed sebum is mixed with a cosmetic, such as a powder component of a makeup remaining on the skin surface, to affect the skin harmfully. Therefore washing the face to remove the decomposed component and the like, to keep the skin surface clean, is the most fundamental of beautifying techniques.

The face can be washed in various ways, and to wash the face, cosmetic specialists point out, for example, 10 items: (1) washing the hands before washing the face; (2) washing the face first only with water, to wash away dirt that can be washed away with water; (3) foam the facial washing toiletry well; (4) not rubbing the facial washing toiletry on the face directly; (5) washing the face with the pads of the fingers gently, with the pads moved in helical patterns; (6) not rubbing the face skin forcibly; (7) not allowing the sides of the nose and the borders of the hair to remain unwashed; (8) rinsing the face with water or lukewarm water sufficiently; (9) washing any remains away with running water or a shower; and (10) pressing a clean towel to the face, to absorb the water.

The present application has paid attention to items (3) to (7) among the above items pointed out by cosmetic specialists, and it has been made to provide a foam generating net for washing the face that can easily produce a soft and silky foam that is friendly to the skin without applying a facial washing toiletry directly to the skin.

SUMMARY OF THE INVENTION

An object of the present invention is to provide a foaming net that can foam a face-washing toiletry to fine silkiness without the need for the development of facial washing toiletries friendly to the skin at low concentrations. As such, this foaming net serves as an auxiliary item friendly to the skin that permits the face to be washed efficiently when used with a conventional face-washing product, which may be a small amount of liquid soap or a small mass of solid soap.

Other and further objects, features, and advantages of the invention will appear more fully from the following description, taken in connection with the accompanying drawings.

DETAILED DESCRIPTION OF THE INVENTION

Figure 1:
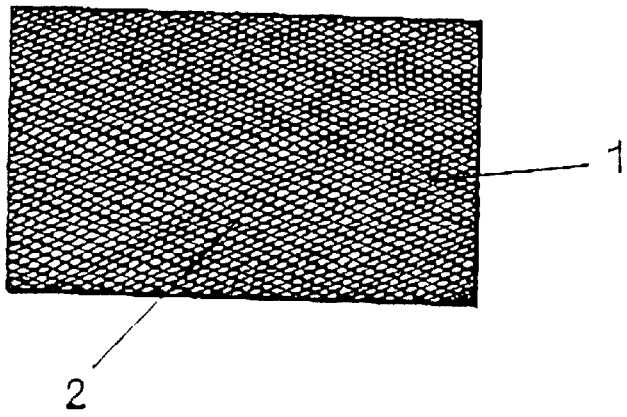
FIG. 1 is a plane view of an integrally molded plastic net having fine meshes.

The above object of the present invention has been attained by the following foam generating nets for washing the face.

(1) A foam generating net for washing the face, wherein a integrally molded plastic net 100 to 280 mm, and preferably 100 to 200 mm, in width, which has vertically and horizontally arranged fine meshes having a size on the order of several millimeters, is cut into a length of 100 to 280 mm, and preferably 100 to 200 mm; each of the opposite ends thereof is gathered and fixed, and a ring through which one's finger is inserted is attached to one end thereof.

(2) A foam generating net for washing the face, wherein a cylindrical integrally molded plastic net 100 to 280 mm, and preferably 100 to 200 mm, in width, which has vertically and horizontally arranged fine meshes having a size on the order on several millimeters, is cut into a length of 100 to 280 mm, and preferably 100 to 200 mm; each of the opposite ends thereof is turned inside, gathered, and fixed, with a string or other sewing piece or by heat fusion, so that it may have an arcuate shape spread radially from the gathered end to be continuous to the cylindrical wall, and a ring through which one's finger is inserted is attached to one end thereof.

(3) A foam generating net for washing the face as stated in the above (2), wherein one end of the integrally molded plastic net is turned inside, gathered, and fixed, with a string or other sewing piece or by heat fusion, so that it may have an arcuate shape spread radially from the gathered end to be continuous to the cylindrical wall, and a ring through which one's finger is inserted is attached to the other end thereof.

(4) A foam generating net for washing the face, wherein an integrally molded plastic net, which has vertically and horizontally arranged fine meshes, having a size on the order of several millimeters, is formed into a glob, having a diameter of 100 to 280 mm, and preferably 100 to 200 mm, and a ring through which one's finger is inserted is attached to an arbitrary position of the glob.

(5) A foam generating net for washing the face, wherein an integrally molded plastic net, which has vertically and horizontally arranged fine meshes, having a size on the order of several millimeters, is formed into a cylinder, having a diameter of 100 to 280 mm, and preferably 100 to 200 mm; one open end of the cylinder is formed with a turned part, that is formed by putting the opposite ends of a flattened fused part together and fusing and fixing them, and the other open end of the cylinder is gathered together and fixed, with it turned inside, and the other open end is equipped with a ring through which one's finger is inserted.

(6) A foam generating net for washing the face stated in the above (5), wherein each of the opposite open ends of said cylinder is fixed by a string or other sewing piece.

In the foam generating net for washing the face of the present invention, each of the opposite ends of a cylindrical net, whose meshes are fine and which is less stretchable, is gathered and set by a string or other fastener or heat fusion and is turned inside, to form a wall spread radially from the gathered end. Therefore, when the net is pressed between one's hands, the middle section of the net is formed into the shape of a disk, and then when the hands are moved apart, the net is formed into the shape of a rod, while taking in air from around the hands, to allow the face-washing toiletry to be mixed with the air, to form bubbles easily.

At that time, the net can be expanded and contracted quite easily, because a finger is inserted into a ring attached to one end of the net. Further, an integrally molded plastic net that allows water to be drained easily and is hygienic is used as a material and is formed approximately into a ball, and a ring through which a finger is inserted is attached to one end thereof. Accordingly, when the net with a finger inserted into the ring is wetted by immersing it in water or lukewarm water, then a suitable amount of a facial washing toiletry is applied to the net, and the net is contracted and expanded or rubbed between the hands, the fine meshes of the net and the walls forming the meshes are rubbed against one another, to allow the water, air, and the facial washing toiletry present therein to be mixed quite efficiently. As a result, a silky and soft foam can be produced within quite a short period of time.

This silky and soft foam can be taken out by scraping the net with the palm of a hand without that ring. Then, after applying the foam to the face, the face can be washed in the manner described above. Thus the face can be washed efficiently within a short period of time.

Further, in the foam generating net for washing the face of the present invention, each of the opposite ends of a cylindrical net is gathered and fixed by a string or other fastener or heat fusion and is turned inside out, to form a wall spread radially from the gathered end. Accordingly, when the net is pressed between the hands, the middle section of the net is formed into the shape of a disk, and then when the hands are moved apart, the net is formed into the shape of a rod, while taking in air from around the hands, to allow the facial washing toiletry to be mixed with the air, to form bubbles easily. At that time, the net can be expanded and contracted quite easily, because a finger is inserted into a ring attached to one end of the net. Further, after washing the face, the ring can be hooked, to dry the net, which is quite convenient and hygienic.

Since the foam generating net for washing the face according to the present invention has fine meshes, it allows air, water, and a facial washing toiletry to be mixed readily, to produce a creamy or silky foam. Since an integrally molded plastic net made of a synthetic resin, such as a polyethylene, is used as the material of the net to foam for washing the face, it is easy to dry and keep hygienic. Since a ring through which a finger is inserted is attached to one end of the net, the net can be expanded and contracted quite easily with a finger inserted into the ring, and, conveniently, the ring of the net can, for example, be hooked, to dry the net after washing the face.

Further, since each end of the net has a shape radially spread from the gathered point like the upper part of an apple among fruits, as the net is forced between the hands, the net is formed into the shape of a glob gradually, and when the net is further pressed between the hands until the hands come well close together, the middle section of the net takes the shape of a disk, so that the air and the facial washing toiletry therein are mixed, excluding superfluities from the net. Then when the hands are opened in the next step, air is introduced from the outside again and is mixed with the facial washing toiletry. Since the meshes of the net are very small, when this step is repeated several times only, a fine foam like a cream can be produced easily, even if a small amount of liquid soap or a small mass of a solid soap is used.

The resulting foam has various excellent properties: for example, when the face is washed with the silky fine foam, a highly concentrated face-washing toiletry does not come in contact with the skin directly; since the resulting foam is friendly to the skin and is silky and soft, when the skin is rubbed with the palms, the foam can act as a cushion to protect the skin; whereas, when a facial washing toiletry is applied to the skin directly and the sides of the nose, the borders of the hair, and parts around the mouth remain unwashed, it causes the skin to be damaged, in contrast, the foam can be washed away with water easily and therefore is friendly to the skin.

EXAMPLES

Next, the present invention is described in more detail based on the examples as shown in figures, but the invention is not to be limited to those.

Example 1

Figure 2:
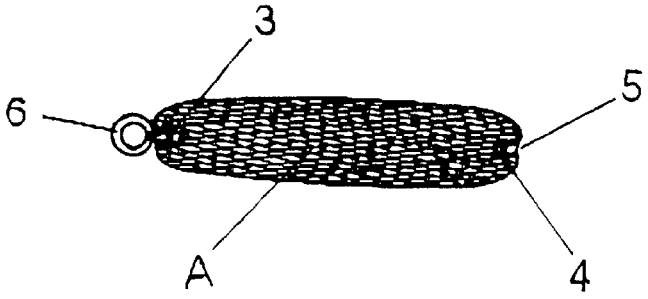
FIG. 2 is a plane view of a foam generating net the face.

Referring to FIGS. 1 and 2, the first embodiment of the present invention is described. A cylindrical integrally molded plastic net made of a polyethylene that measures about 180 mm in width and that has fine meshes (1) of several millimeters in size and arranged vertically and horizontally, is cut into a base material (2) having a length of about 180 mm. Each of the upper end and the lower end of the base material (2) is gathered and set by means of a binder (3), such as a string, or by heat fusion, to form a set end fringe section (4). The end fringe section (4) is turned inside so that the end (5) of the cylindrical net may have a shape radially spread from one point (like the shape of the upper part of an apple), and a ring (6) through which a finger is inserted is attached to one end. In this way, the net to foam for washing the face (A) is made.

In this Example, both end fringes (4) are turned inside, but if only one end is turned, the same effect can be secured when the material of the net is highly resilient.

Example 2

Figure 3:
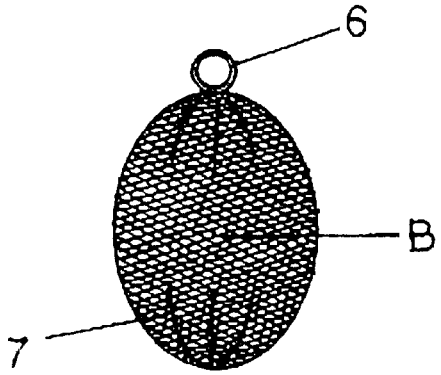
FIG. 3 is a plane view of a foam generating net the face made of a base material formed into a glob.

Another embodiment of the present invention is described, referring to FIG. 3. The embodiment shown is made by cutting suitably the base material (2), to form into a globe, and by sewing, fusing, or the like, to form a globular net to foam for washing the face (B). In the figure, (7) indicates a sewed or fused section.

Figure 4:
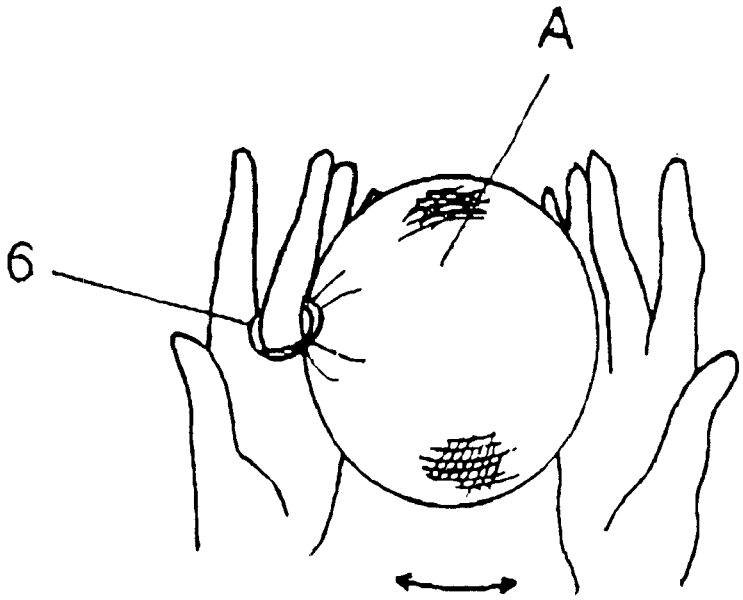
FIG. 4 is an illustrative view of the foam generating net for washing the face that is attached to a hand.
Figure 5:
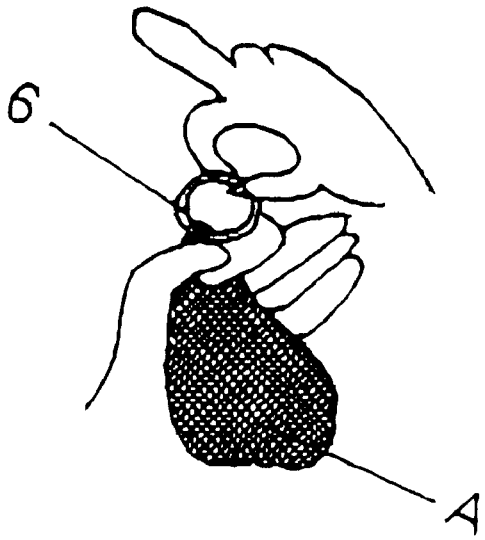
FIG. 5 is an illustrative view showing how to take bubbles onto a palm.

After the net to foam for washing the face of Example 1 or 2, constructed as described above, or of the below-described Example 3, is wetted with water or tepid water, and one's finger is inserted into the ring (6) as shown in FIG. 4, soap or foam is applied to the net, and the net is rubbed well between one's palms, so that a fine creamy foam can be made within several seconds. Then, by squeezing out the fine foam, as shown in FIG. 5, a facial washing toiletry having a silky touch is prepared.

Example 3

Figure 6:
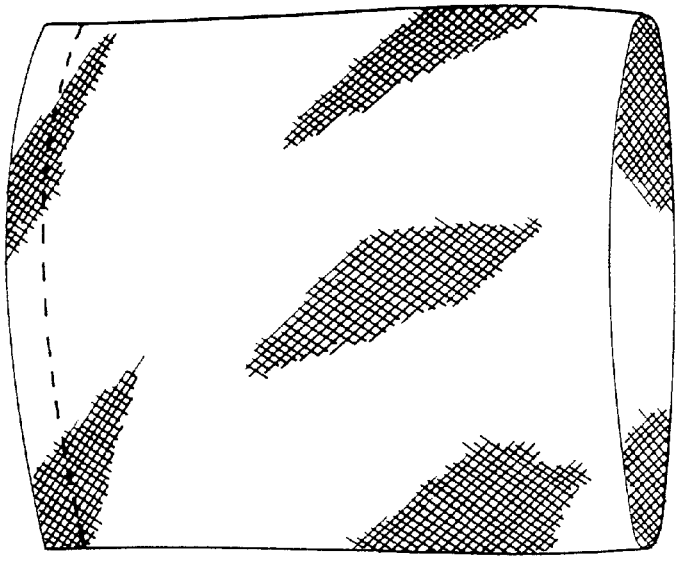
FIG. 6 is an illustrative view showing a cylindrical, integrally molded plastic net whose one open end is in a state fixed by heat fusion.
Figure 7:
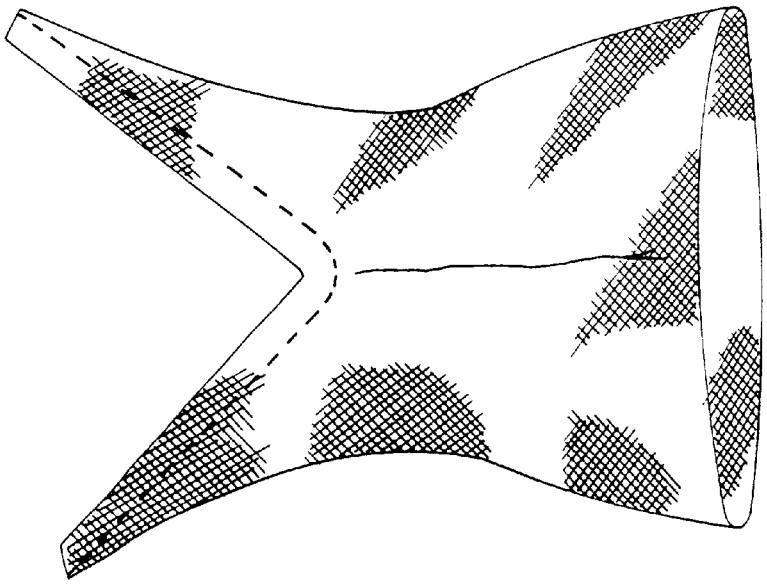
FIG. 7 is an illustrative view showing the state following that shown in FIG. 6, wherein the opposite ends of the flattened fused part are being bent.
Figure 8:
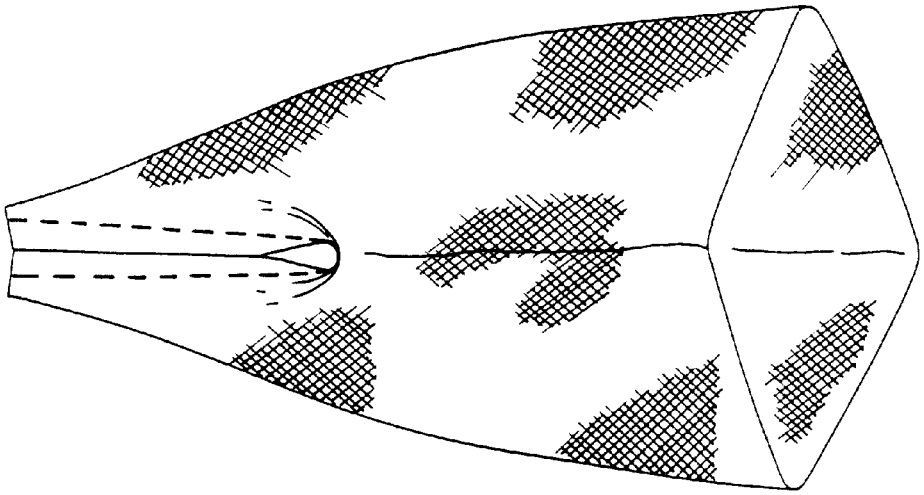
FIG. 8 is an illustrative view showing the state following that shown in FIG. 7, wherein the opposite ends of the flattened fused part are put together and fixed.
Figure 9:
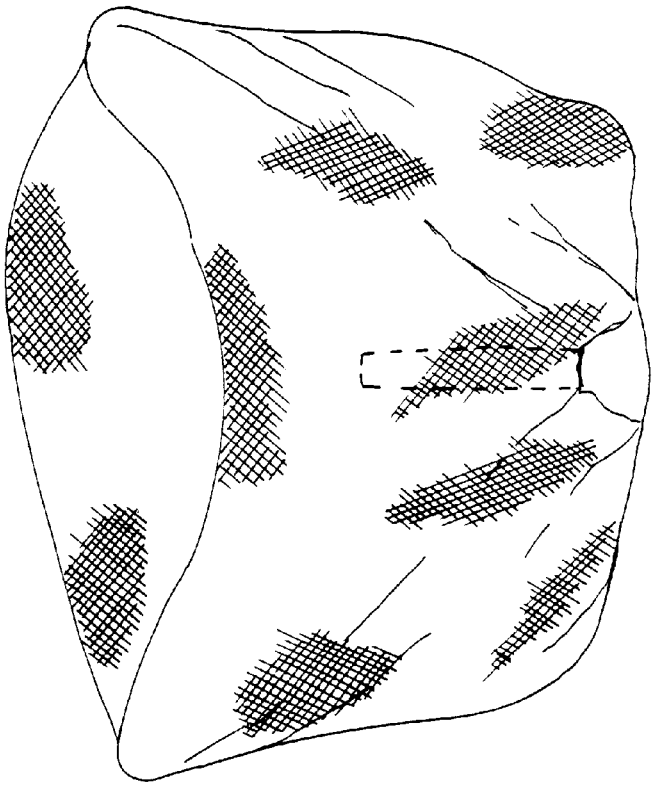
FIG. 9 is an illustrative view showing the state following that shown in FIG. 8, wherein the cylindrical integrally molded plastic net is turned inside out, so that the other open end of the cylindrical integrally molded plastic net may be gathered and sewn.
Figure 10:
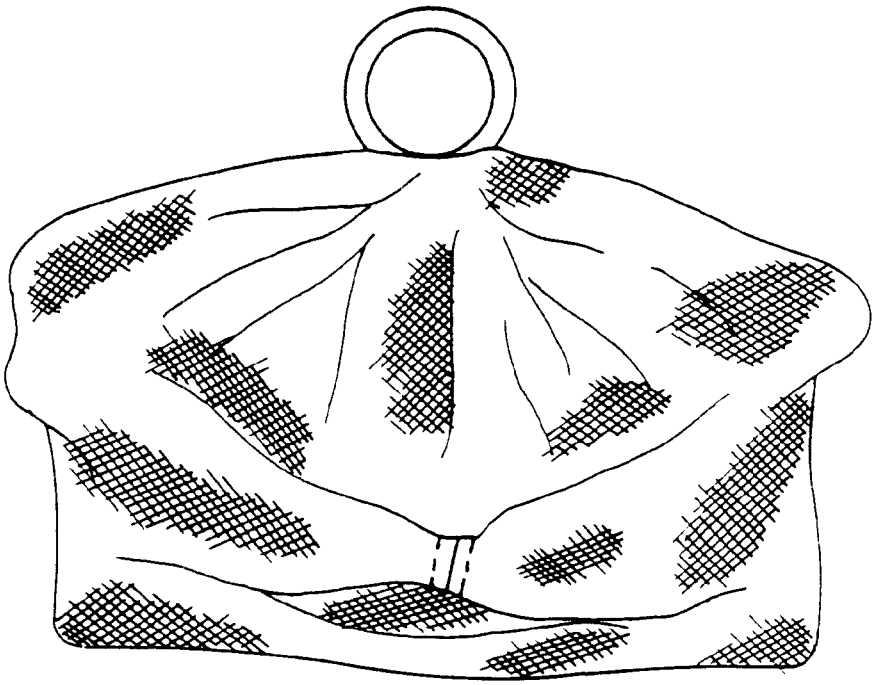
FIG. 10 is a view of the general appearance showing the configuration of the foam-generating net for washing the face, following the state shown in FIG. 9, wherein said other open end is gathered and sewn and a ring is attached to the end.

FIGS. 6 to 10 show generally the foam generating net washing the face, to which a third embodiment of the present invention is applied; FIG. 6 is a view showing a cylindrical, integrally molded plastic net whose one open end is in a state fixed by heat fusion; FIG. 7 is a view showing the halfway state when the opposite ends of the flattened fused part are being bent; FIG. 8 is a view of the state when the opposite ends of the flattened fused part are put together and fixed; FIG. 9 is a view of the state when the cylindrical integrally molded plastic net is turned inside out, so that the other open end of the cylindrical integrally molded plastic net may be gathered and sewn; and FIG. 10 is a view of the general appearance showing the constitution of the foam generating net for washing the face.

Referring to FIGS. 6 to 10, showing the foam generating net for washing the face to which the third embodiment is applied, one open end of a base material (2) formed by cutting a cylindrical integrally molded plastic net into a suitable length, is flattened and fixed by heat fusion (FIG. 6). Then the opposite ends of the flattened and fused part are bent, so that they may be brought together, and the overlapped parts are fixed by fusing (FIGS. 7 and 8). Thereafter, the other opening of the base material (2) of the above integrally molded plastic net is turned inside out, so that the above fused part is positioned within the cylinder (FIG. 9); the turned other opening is gathered radially with it turned inside, and both the fixed parts formed at the opposite opening ends are positioned inside the cylinder (FIG. 10).

In the third embodiment, the multi-folded overlapped parts of the base material (2) and the turned overlapped parts further improve the creamy fine foaming.

Having described our invention as related to the present embodiments, it is our intention that the invention not be limited by any of the details of the description, unless otherwise specified, but rather be construed broadly within its spirit and scope as set out in the accompanying claims.

What I claim is:

1. A foam-generating net for washing the face, comprising an integrally molded plastic net 100 to 280 mm in width having a cylindrical wall and two opposite ends, said net being constructed of vertically and horizontally arranged fine mesh cut into a length of 100 to 280 mm, wherein each of the opposite ends thereof is turned inside, gathered, and fixed with a string, to provide said length of net with an arcuate shape spread radially from both gathered cylinder ends to be continuous to the cylindrical wall of said length of net, and wherein a ring through which a finger may be inserted is attached to one of said gathered ends.

2. A foam-generating net for washing the face as claimed in claim 1, wherein only one end of the integrally molded plastic net is turned inside, gathered, and fixed with a string.

3. A foam-generating net for washing the face, wherein an integrally molded plastic net of vertically and horizontally arranged fine mesh is formed into a globe having a diameter of 100 to 280 mm, and a ring through which a finger may be inserted is attached to an arbitrary position of the globe.

4. A foam-generating net for washing the face, comprising an integrally molded plastic net of vertically and horizontally arranged fine mesh formed into a cylinder having two open ends and having a diameter of 100 to 280 mm, wherein one open end of the cylinder is formed with a turned part, that is formed by putting opposite ends of a flattened fused part of the cylinder together and fusing and fixing them, and wherein the other open end of the cylinder is turned inside, gathered together, and fixed, and includes a ring through which a finger may be inserted.

5. A foam-generating net for washing the face as claimed in claim 4, wherein both of the opposite open ends of said cylinder are fixed by a string.

6. A foam-generating net for washing the face, comprising an integrally molded plastic net 100 to 280 mm in width having a cylindrical wall and two opposite ends, said net being constructed of vertically and horizontally arranged fine mesh cut into a length of 100 to 280 mm, wherein each of the opposite ends thereof is turned inside, gathered, and fixed by heat fusion, to provide said length of net with an arcuate shape spread radially from both gathered cylinder ends to be continuous to the cylindrical wall of said length of net, and wherein a ring through which a finger may be inserted is attached to one of said gathered ends.

7. A foam-generating net for washing the face as claimed in claim 6, wherein only one end of the integrally molded plastic net is turned inside, gathered, and fixed by heat fusion.

* * * * *